US006637547B1

(12) United States Patent
Wydner

(10) Patent No.: US 6,637,547 B1
(45) Date of Patent: Oct. 28, 2003

(54) SAFETY HUNTING HARNESS AND GARMENT

(76) Inventor: John D. Wydner, 5267 Danville Rd. SW., Danville, AL (US) 35619

( * ) Notice: Subject to any disclaimer, the term of this patent is extended or adjusted under 35 U.S.C. 154(b) by 0 days.

(21) Appl. No.: 09/950,257

(22) Filed: Sep. 10, 2001

(51) Int. Cl.[7] ..... A62B 35/00
(52) U.S. Cl. ..... 182/3
(58) Field of Search ..... 182/3–7; 2/102, 2/69

(56) References Cited

U.S. PATENT DOCUMENTS

| | | | | |
|---|---|---|---|---|
| D147,127 | S | | 7/1947 | Hutchinson |
| 2,996,228 | A | | 8/1961 | Bauman |
| 4,177,877 | A | | 12/1979 | Gallinati |
| 4,273,215 | A | | 6/1981 | Leggett |
| D270,585 | S | | 9/1983 | Viio |
| 4,478,311 | A | | 10/1984 | Anderson |
| D279,520 | S | | 7/1985 | Brinson, Jr. |
| 4,706,858 | A | | 11/1987 | Whatley |
| D315,978 | S | | 4/1991 | Scott |
| 5,738,046 | A | | 4/1998 | Williams et al. |
| 5,890,227 | A | * | 4/1999 | Brown ..... 2/102 |
| 6,035,440 | A | | 3/2000 | Woodyard |
| 6,101,631 | A | | 8/2000 | Ferguson, Jr. |
| 6,122,778 | A | * | 9/2000 | Cohen ..... 182/3 |
| 6,128,782 | A | | 10/2000 | Young et al. |
| 6,367,582 | B1 | * | 4/2002 | Derby ..... 119/857 |

* cited by examiner

*Primary Examiner*—Alvin Chin-Shue
(74) *Attorney, Agent, or Firm*—Lanier Ford Shaver & Payne, P.C.

(57) ABSTRACT

A safety garment having a harness with vertical shoulder straps and a back strap, each having one or more loops in which horizontal straps are slidably inserted and are extendable around the upper body of a user. The horizontal straps have connectors external to the garment to close the garment and the horizontal straps, adjustably thereby rendering the horizontal straps slidably adjustable around the upper body of a user.

24 Claims, 5 Drawing Sheets

SAFETY HUNTING HARNESS AND GARMENT

BACKGROUND OF INVENTION

1. Field of Invention

The present invention relates to the field of safety body garments in general and in particular to an adjustable safety garment for use with a fall arresting harness.

2. Technical Background

In cases where an individual is engaging in activity at an elevation, sitting or standing on a support, it is common to wear a harness on the upper body and to tether the upper part of the harness to a fixed object. If the support fails, the individual will fall only a short distance and be suspended from the fixed object, thereby avoiding injury from a fall to the ground. A particular well known use includes a hunter elevated above the ground on a tree stand, tethered to the tree with a harness worn around the upper torso.

Safety harnesses combined with garments are known. These safety garments are designed to overcome the inconvenience of a harness which has many loops and straps, having a tendency to become twisted and entangled with one another. It can be relatively time consuming and tedious putting on the harness. When the harness is inside, outside, or between inner and outer layers of a garment, putting on the harness is as easy as putting on a jacket.

A problem with safety garments having harnesses fixedly attached therein or thereon is that they are difficult to adjust to a user's body. These garments require access to buckles inside the garment which have to be adjusted by trial and error to get a suitable fit. Often these are somewhat complicated buckle and snap systems. In some cases, adjusting the harness twists the garment making the garment uncomfortable to wear. These drawbacks have prevented the widespread use of a combined safety harness garment. The present invention provides a simple harness arrangement in a garment which is rapidly adjustable externally, does not distort the shape or position of the garment after adjustment, and does not compress a user's diaphragm when a user is suspended in the harness. The present invention also fulfills the need to conveniently put on a harness quickly and simply.

SUMMARY OF INVENTION

The present invention is a safety garment which comprises a garment having a safety harness fixed to the inside or outside of the garment or between the inner and outer layers of the garment. The harness has one or more vertical back straps and vertical shoulder straps. Each of these vertical straps has a plurality of loops, preferably two. This harness can be attached to the garment, but preferably, is attached between the inner and outer layers of the garment. The loops in the vertical straps are, preferably at the level of the chest and waist. A first horizontal strap is inserted slidably through the loops at the level of the chest and a second horizontal strap is inserted slidably through the loops at the level of the waist. One end of the horizontal strap is slidably attached to a clip and the other end is fixed to a clasp. The horizontal straps extend around the upper body of a user and the clip is inserted reversibly into the clasp to form a buckle external to the garment. The circumference of the horizontal straps around the upper body of the user is adjusted by pulling one end of the horizontal strap through the clip portion of the buckle. The horizontal position of the buckles at the front of the garment can be adjusted as desired by sliding the horizontal straps to the left or right as desired, thus preventing the garment from twisting or becoming deformed after adjusting of the horizontal straps. The horizontal straps can easily slide freely to the left or right because they are not attached to the harness or the garment. Nevertheless, the combination of the harness and horizontal straps provide excellent support and protection when a user is suspended. The top of the vertical back strap has a loop to attach a tether or lanyard for connection to a supporting object. The bottom of the vertical back strap also has a loop to attach a tether for towing an object.

An advantage of the present invention is a horizontally adjustable safety garment.

Another advantage of the present invention is a reversible safety garment.

Another advantage of the present invention are horizontal straps which slide freely through the garment.

Another advantage of the present invention are buckles positioned external to the garment.

Another advantage of the present invention are loops for tethering at the top and bottom of the garment.

Another advantage of the present invention is a safety harness attached to a garment between the inner and outer layers of the garment, thereby simplifying attaching the harness to the upper body of a user.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1A:
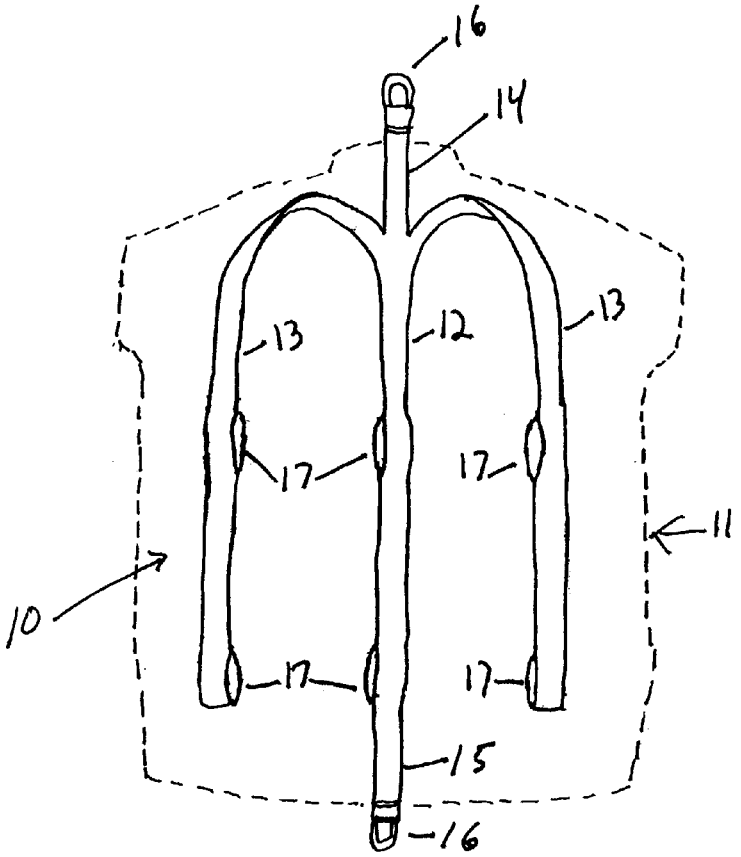
FIGS. 1*a* and 1*b* show the harness and horizontal straps of the present invention within the outline of a vest garment.
Figure 1B:
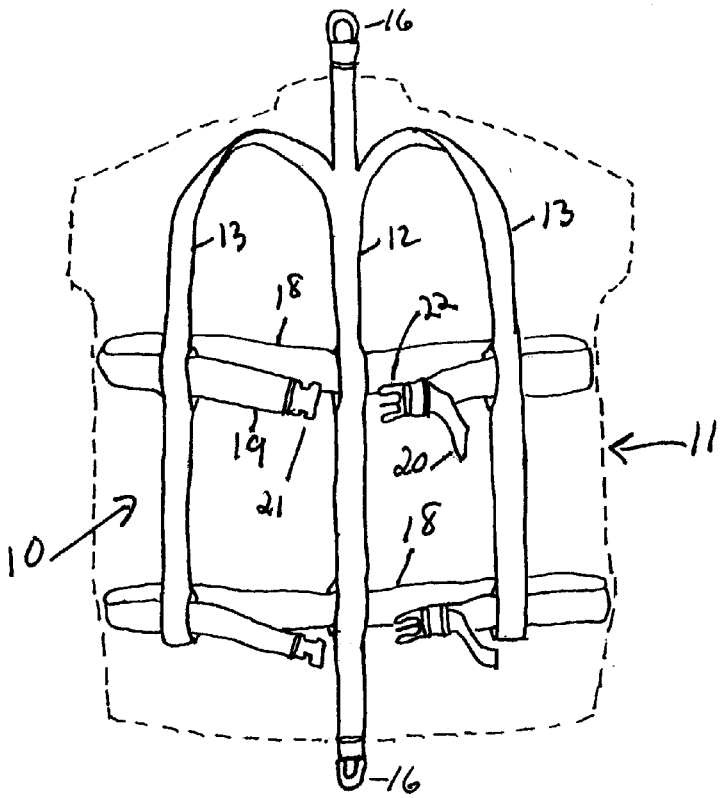
Figure 1C:
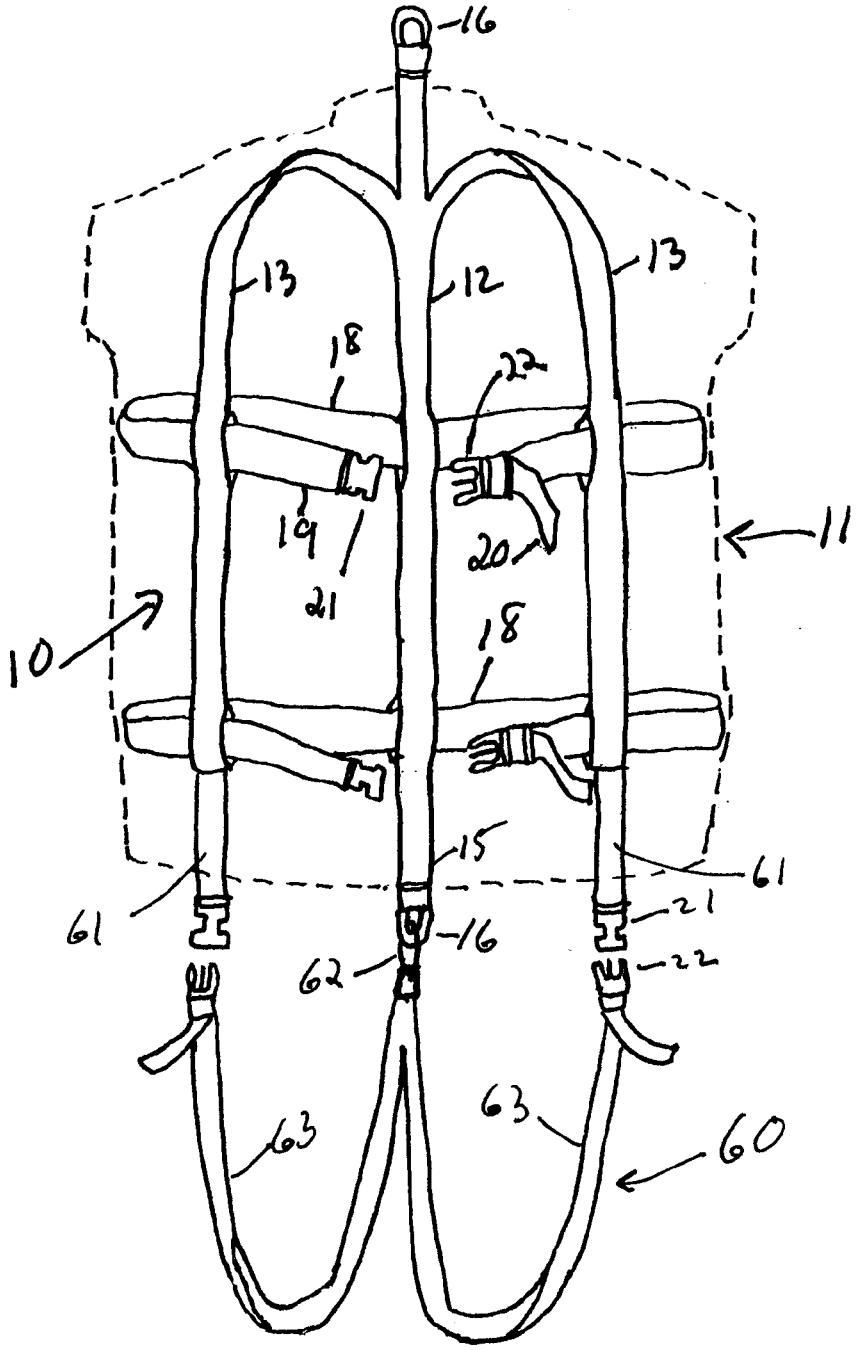
FIG. 1*c* illustrates the use of leg straps with the harness.

FIG. 1*a* shows the harness 10 of the present invention within the outline of a vest garment 11. The harness 10 has vertical back strap 12 and two vertical shoulder straps 13. Harness 10 may have more than one vertical back strap 12. Vertical back strap 12 has a top end 14 and a bottom end 15. Ends 14 and 15 each have a ring 16. These vertical straps 12 and 13 have one or more loops 17, preferably at the level of the chest and waist. Vertical straps 12 and 13 or harness 10 can be attached to the outside or inside of the garment 11. However, garments usually have an inner lining 30 and an outer lining 31 (See FIG. 2) and straps 12 and 13 can be attached to garment 11 between the inner lining 30 and the outer lining 31. Harness 10 is attached to garment 11 following the natural contours of the shoulders, back, and front of the garment 11. Attachment of the vertical straps 12 and 13 of harness 10 to garment 11 is, preferably, by stitching, but may also be by riveting, gluing, or a combination thereof FIG. 1*b* shows harness 10 with horizontal straps 18 inserted through loops 17 of vertical straps 12 and 13. Each horizontal strap 18 can also be contained between inner layer 30 and outer layer 31 of garment 11 along with harness 10 (See FIG. 2). Each horizontal strap 18 has a first end 19 and an opposite second end 20. First end 19 is attached to clasp 21, preferably permanently, and second end 20 is slidably and reversibly attached to clip 22. When clip 22 is reversibly inserted into clasp 21, buckle 40 is formed (See FIG. 3). The horizontal straps 18 can be adjusted by pulling ends 20 through clip 22, thereby. adjusting the circumference of horizontal straps 18 around the upper body of a user. The harness 10 and horizontal straps 18 may be constructed of plastic, cloth, rubber, or a combination thereof Harness 10 may also be used with leg straps as shown in FIG. 1*c*. Leg straps 60 have two leg loops 63 which are joined together at one end with a clip 62 which can reversibly attach with clasp 62 to ring 16 at the bottom end 15 of vertical back strap 12. The opposite ends of leg loops 63 have clips 22 which insert into clasps 21 on extensions 61 from the bottom ends of vertical shoulder straps 13. Leg straps 60, thus connect bottom end 15 of vertical back strap 12 to the bottom end (waist) of vertical shoulder straps 13.

Figure 2:
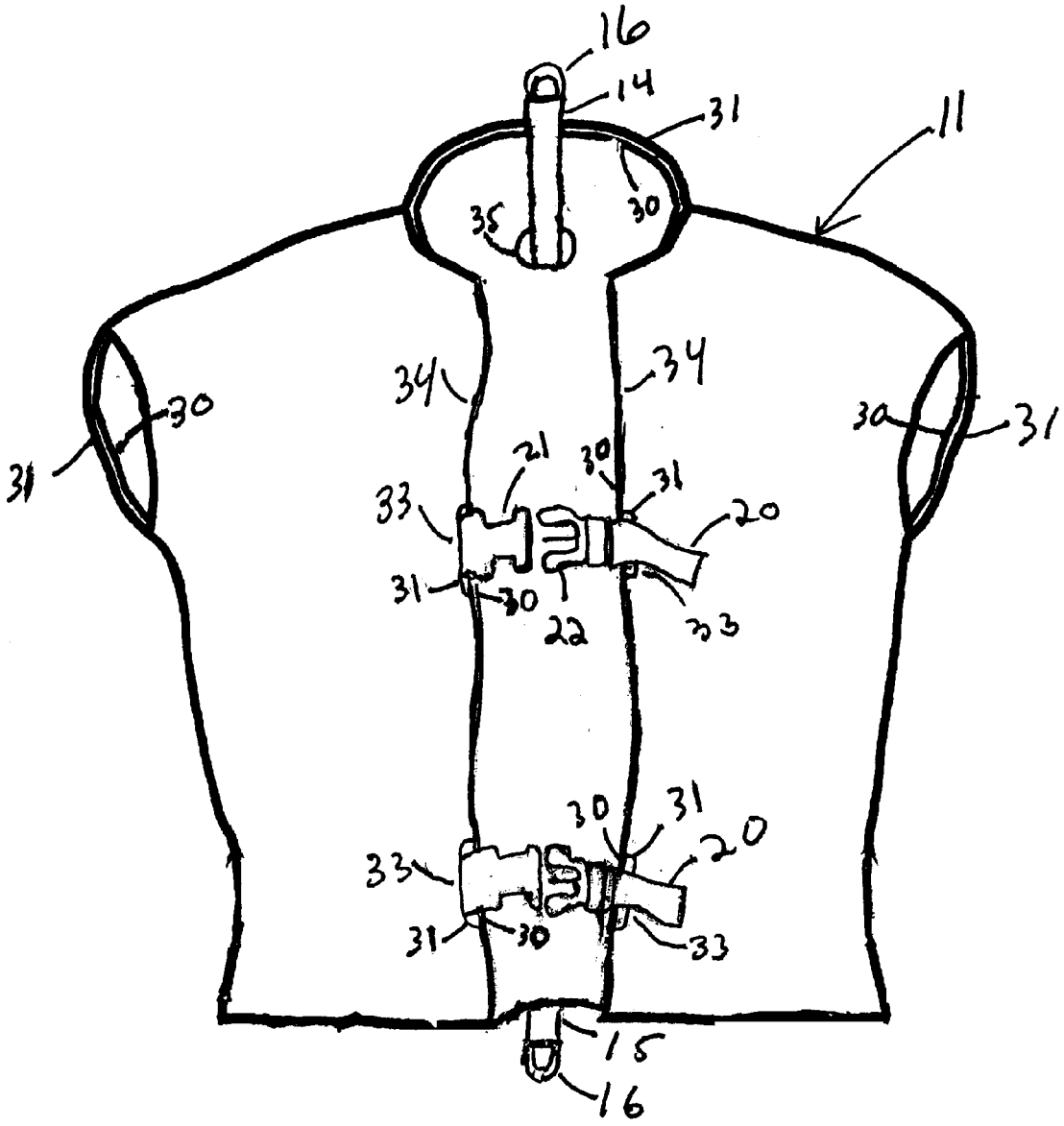
FIG. 2 Illustrates an embodiment of a vest garment of the present invention showing buckles external to the garment.

FIG. 2 shows a garment 11 in the shape of a vest having an inner layer 30 and an outer layer 31, typical of many garments. Garment 11 could also be a jacket, coat, or full body garment. Harness 10 and horizontal straps 18 can be positioned between inner layer 30 and outer layer 31 so they are not visible and garment 11 can be made reversible, i.e., it can also be worn inside out. The front lapel portions 34 of garment 11 have openings 33 through which the clasps 21 and clips 22 extend. Clip 22 is inserted into clasp 21 forming buckles 40 and bringing lapels 34 together thereby closing garment 11. The horizontal straps 18 can be adjusted by pulling ends 20. Buckles 40 may be displaced to one side after adjustment of horizontal straps 18. Buckles 40 can be pulled into place as desired by rotating horizontal straps 18 around the user as needed. This is possible because the horizontal straps 18 are not fixedly connected to anything but, rather, are slidably inserted through loops 17 and garment openings 33. Nevertheless, the horizontal straps 18 positioned in loops 17 are sufficient, in conjunction with harness 10, to suspend a user comfortably and safely in a vertical position when the harness 10 is tethered to an object. The top end 14 of vertical back strap 12 should, preferably, exit the garment 11 from opening 35 at the level of the shoulders.

Figure 3A:
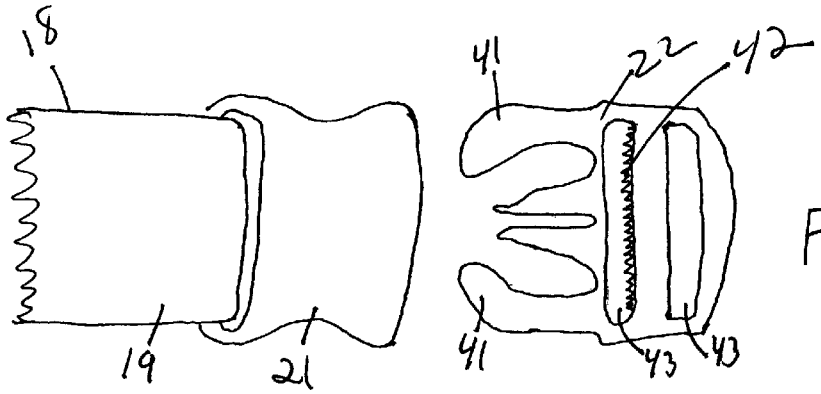
FIGS. 3*a, b*, and *c* show the clip and clasp of the buckle assembly used in the present invention for adjusting and closing the garment and harness around the upper body of a user.
Figure 3B:
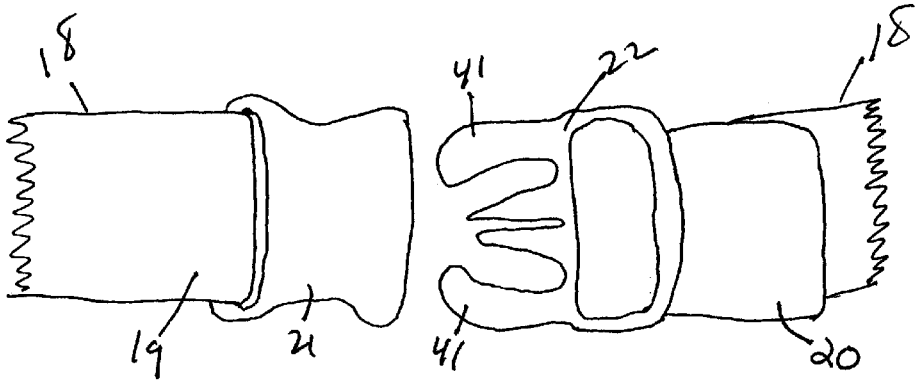
Figure 3C:
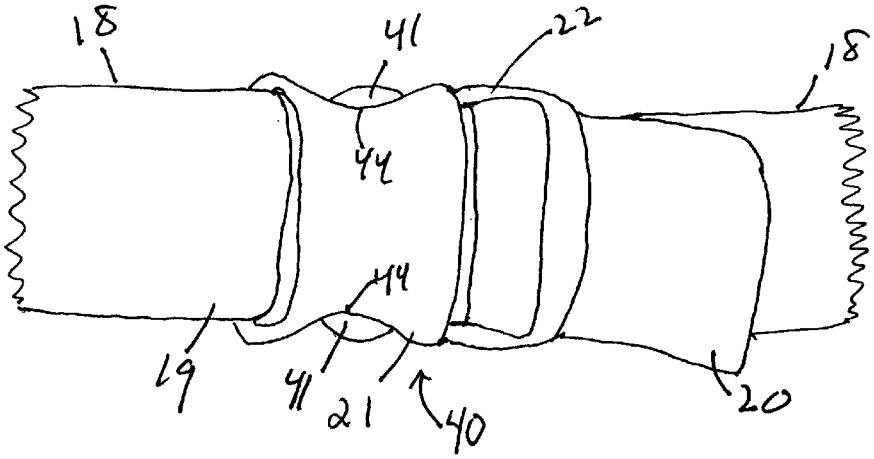
Figure 4:
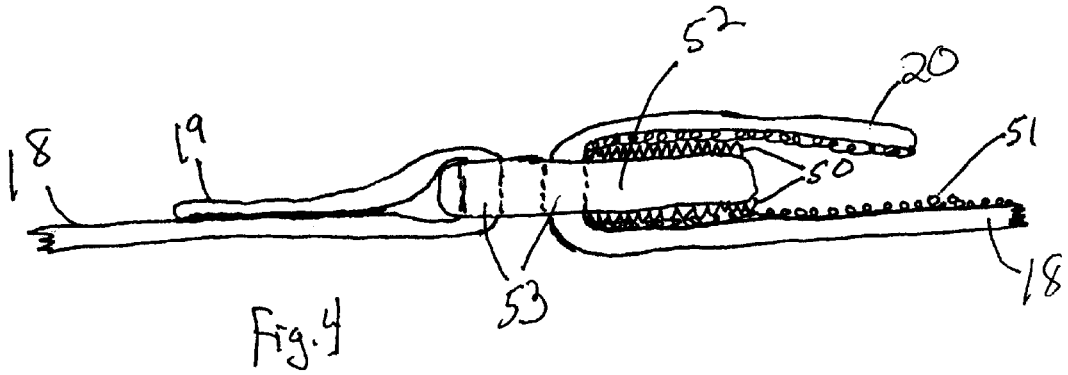
FIG. 4 shows an alternate embodiment of the buckle for adjusting and closing the garment and harness around the upper body of a user.

FIGS. 3*a, b*, and *c* show the clip 22 and clasp 21 of the buckle assembly 40 of the present invention. End 19 of horizontal strap 18 is attached, preferably permanently, to clasp 21. Clip 22 has openings 43 for the insertion of second end 20 of horizontal strap 18, as shown in FIG. 3b. Clip 22 also has frictional elements or teeth 42 to grasp horizontal strap 18 to prevent strap 18 from sliding through clip 22 unless clip 22 is rotated outward away from garment 11. Clip 22 further has compressible prongs 41 which bend inward when inserted into clasp 21 and then extend outward into openings 44 in clasp 21. Clip 22 can be released from clasp 21 by compressing prongs 41 inward and pulling clip 22 out of clasp 21. When clip 22 is inserted into clasp 21 it forms buckle assembly 40 as shown in FIG. 3*c*. This type of buckle assembly is well known in the art and is particularly suited to the safety garment of the present invention. However, any known type of adjustable connectors or fastening arrangements can be used to close the garment harness. For example, as shown in FIG. 4, end 19 may loop through an opening 53 in a connector 52 and attach to itself reversibly or permanently, and end 20 may be inserted through an opening 53 in connector 52 and then folded over to attach to the connector 52 with a hook 50 and pile 51 arrangement, or to horizontal strap 18 with a three bar slide.

In order to use the harness or garment of the present invention, the harness, or the garment with the harness attached, is placed on the upper body of the user and the buckle 40 is closed by inserting clip 22 into clasp 21. For the best protection, the harness or garment is adjusted to fit snugly on the upper body of the user by pulling or sliding ends 20 of horizontal straps 18 through clips 22 to reduce or adjust the circumference of horizontal straps 18 around the upper body of the user. Pulling ends 20 may dislocate buckles 40 to one side and the harness 10 or garment 11 will become twisted. This twisting can be removed and the desired shape of the harness 10 or garment 11 restored by slidably rotating the horizontal straps 18 around the upper body of the user until the buckles 40 and the harness 10 or garment 11 are adjustably positioned as desired. Once the harness 10 or garment 11 is fitted on the user, one end of a tether or lanyard may be attached to an object, such as, for example, a tree, and the other end to ring 16 at top end 14 of vertical back strap 12 for suspending a user. Alternatively, one end of a tether or lanyard may be attached to an object, such as, for example, a slain deer, and the other end to ring 16 at bottom end 15 of vertical back strap 12 for towing the deer.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the garment may have a camouflage appearance on the outer lining, and be colored hunter's safety orange on the inner lining. The openings in the garment may have zippers to contain the buckles within the inner lining. The garment may have other means of closure besides the buckles, such as zippers, snaps, buttons, and the like. The garment may be made of any suitable materials, such as, for example, cloth, plastic, rubber, and the like. The harness with the horizontal straps and buckles can be worn without the garment as a safety harness.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A modular fall-arresting safety harness, comprising:

a) a single, centrally oriented, vertical back strap having a top end and a bottom end, and vertical shoulder straps, said top end of said vertical back strap having a single ring to secure said harness to an object for suspension of a user from the object;

b) said vertical shoulder straps being integrally formed and joined to said top end of said single vertical back strap;

c) said single vertical back strap and said vertical shoulder straps each having one or more loops; and d) one or more horizontal straps inserted slidably through said loops and being extendable around the upper body of a user and wherein said bottom end has a ring to secure said harness to an object to tow the object.

2. The safety harness of claim 1 wherein said horizontal strap has a first end and a second end, said connector has a first part and a second part, said first part being fixedly attached to said first end and said second part being slidably attached to said second end.

3. The safety harness of claim 2 wherein said horizontal strap is circumferentially adjustable around the upper body of a user by sliding said horizontal strap through said second part of said connector.

4. The safety harness of claim 1 wherein said harness is composed of plastic, cloth, rubber, or a combination thereof.

5. The safety harness of claim 1 wherein said harness has two horizontal straps, one extendable about the chest and the other about the waist of a user.

6. The safety harness of claim 1 wherein said horizontal strap is capable of being positionally adjustable about the upper body of a user by slidably rotating said horizontal strap through said loops in said vertical straps.

7. The safety harness of claim 3 wherein said connectors are buckles.

8. The safety harness of claim 7 wherein said first part of said connector is a clasp and second part of said connector is a clip.

9. The safety harness of claim 1 wherein said connector comprises a hook and pile arrangement.

10. A modular fall-arresting safety garment, comprising:

a) a single, centrally oriented, vertical back strap having a top end and a bottom end, and vertical shoulder straps, said top end of said vertical back strap having a single ring to secure said harness to an object for suspension of a user from the object;

b) said vertical shoulder straps being integrally formed and joined to said top end of said single vertical back strap;

c) said single vertical back strap and said vertical shoulder straps each having one or more loops;

d) one or more horizontal straps inserted slidably through said loops and being extendable around the upper body of a user and wherein said bottom end has a loop to secure said harness and said safety garment to an object to tow the object; and e) said horizontal straps having connectors external to said garment to close said garment.

11. The safety garment of claim 10 wherein said garment is reversible.

12. The safety garment of claim 10 wherein said vertical straps are attached to said garment.

13. The safety garment of claim 12 wherein said garment has an inner layer and an outer layer, said vertical straps being attached to said garment between said inner and outer layers.

14. The safety garment of claim 10 wherein said horizontal strap has a first end and a second end, said connector has a first part and a second part, said first part being fixedly attached to said first end and said second part being slidably attached to said second end.

15. The safety garment of claim 14 wherein said horizontal strap and said garment are circumferentially adjustable around the upper body of a user by sliding said horizontal strap through said second part of said connector.

16. The safety garment of claim 15 wherein said garment has openings for said horizontal straps.

17. The safety garment of claim 10 wherein said harness and said garment are composed of plastic, cloth, rubber, or a combination thereof.

18. The safety garment of claim 10 wherein said garment has two horizontal straps, one extendable about the chest and the other about the waist of a user.

19. The safety garment of claim 10 wherein said horizontal strap is capable of being positionally adjustable about the upper body of a user by slidably rotating said horizontal strap through said loops in said vertical straps.

20. The safety garment of claim 15 wherein said connectors are buckles.

21. The safety garment of claim 20 wherein said first part of said connector is a clasp and said second part of said connector is a clip.

22. The safety garment of claim 10 wherein said connector comprises a hook and pile arrangement.

23. The safety garment of claim 10 further comprising leg straps connecting to said vertical straps.

24. The safety garment of claim 10 wherein said back strap exits said garment at the level of the shoulder.

* * * * *